United States Patent [19]

Chang

[11] 3,945,745

[45] Mar. 23, 1976

[54] TRAFFIC FLOW CONTROL SYSTEMS

[76] Inventor: Amos I. T. Chang, 701 Harris Ave., Manhattan, Kans. 66502

[22] Filed: Aug. 5, 1974

[21] Appl. No.: 495,078

[52] U.S. Cl. ..... 404/1
[51] Int. Cl.[2] ..... E01C 1/00
[58] Field of Search ..... 404/1

[56] References Cited

UNITED STATES PATENTS

| | | | |
|---|---|---|---|
| 1,543,080 | 6/1925 | Graves | 404/1 |
| 3,272,097 | 9/1966 | Gazis | 404/1 |
| 3,533,062 | 10/1970 | Coffman | 404/20 X |

FOREIGN PATENTS OR APPLICATIONS

| | | | |
|---|---|---|---|
| 265,349 | 10/1968 | Austria | 404/1 |
| 1,523,478 | 3/1968 | France | 404/1 |

*Primary Examiner*—Nile C. Byers
*Attorney, Agent, or Firm*—Mason, Fenwick & Lawrence

[57] ABSTRACT

A street pattern is disclosed including a honeycomb pattern of traffic arteries; pedestrian passageways under the streets; unique artery dividing median means and public transit facilities between adjacent honeycomb legs.

9 Claims, 19 Drawing Figures

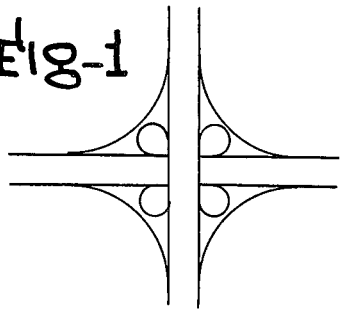
Fig-1
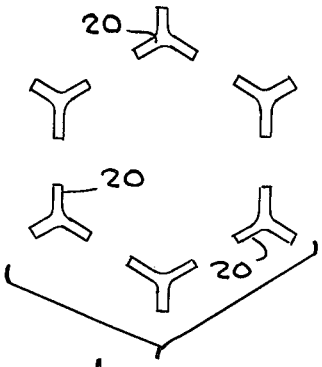
Fig-3-A
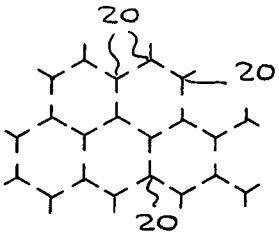
Fig-3-B
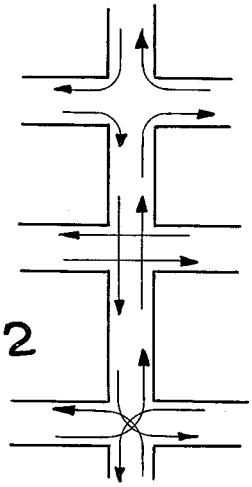
Fig-2
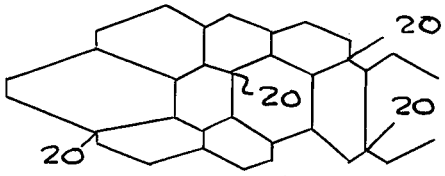
Fig-3-C
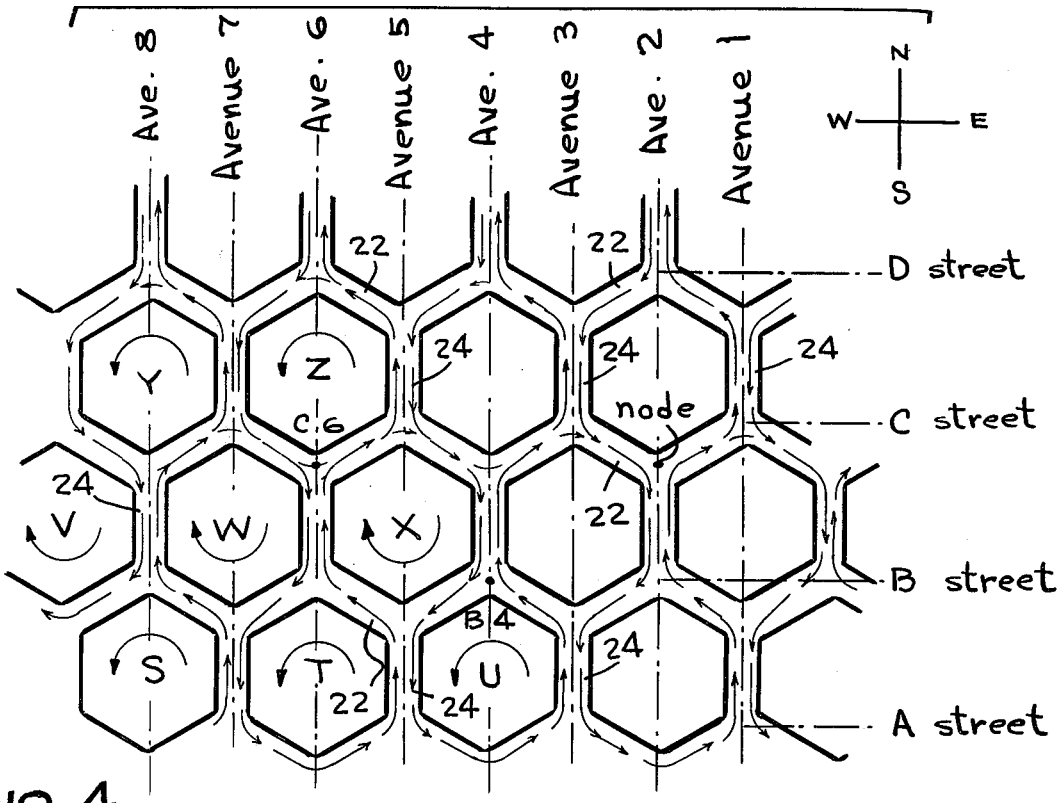
Fig-4

| | | | | | | | | | | |
|---|---|---|---|---|---|---|---|---|---|---|
| 9 | 8 | 7 | 6 | 5 | 4 | 3 | 2 | 1 | 0 | — Turning Points |
| B6 | B5 | B4 | B3 | B2 | C2 | C3 | D3 | D2 | E2 | — Nodes |
| $2^9$ | $2^3$ | $2^7$ | $2^6$ | $2^5$ | $2^4$ | $2^3$ | $2^2$ | $2^1$ | 1 | — Binary Sequence |
| | R | L | R | R | R | L | L | R | R | — Turning |
| | 1 | 0 | 1 | 1 | 1 | 0 | 0 | 1 | 1 | — Binary Numeral |

← Reading

A time-space Graph

Wishbone Underpass

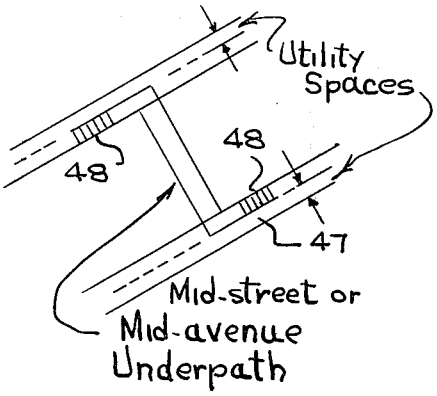
Fig-14
Fig-15
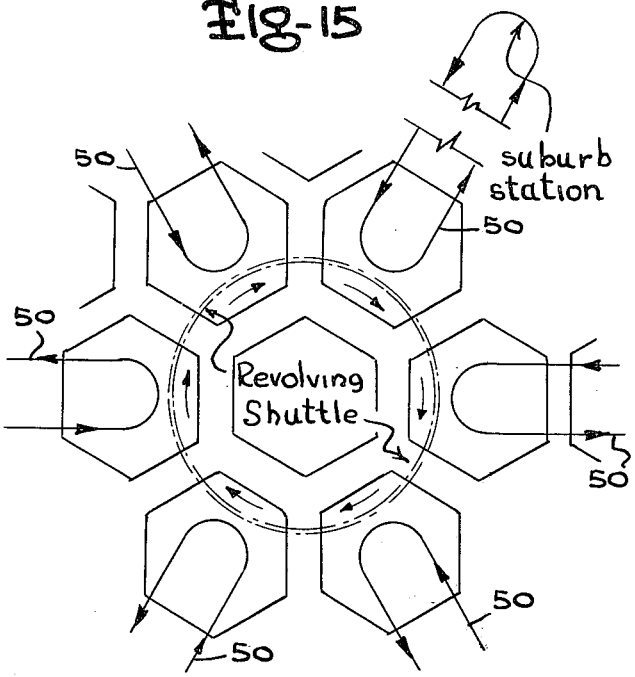
Fig-16
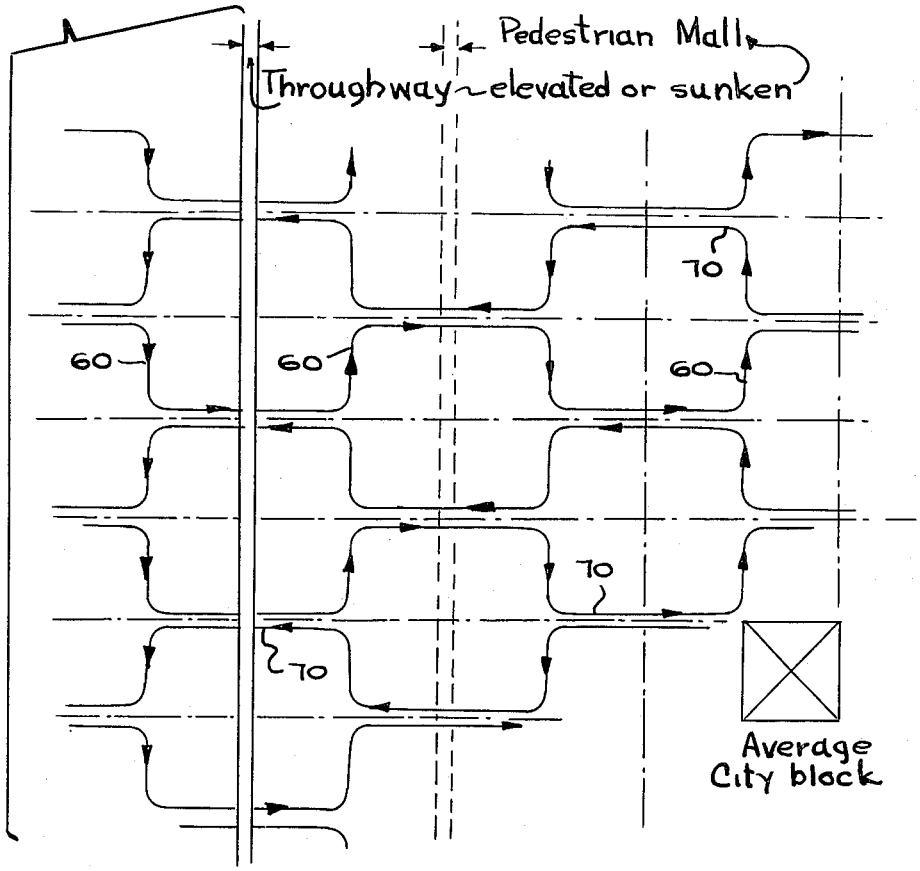

TRAFFIC FLOW CONTROL SYSTEMS

BACKGROUND OF THE INVENTION

The subject invention is in the field of traffic control flow systems. Two physical systems have emerged as the twin symbols of our automobile civilization; namely, the cloverleaf interchange system for high speed traffic and the intersection traffic signal system for low-speed traffic control purposes. The monumental problem of traffic complication and harassment has progressed and grown to such a great extent as to largely strangle urban existence.

By function, a cloverleaf system offers high efficiency in a traffic interchange. By form, it consists of a complex and expansive bridging, turning and ramping construction whose cost is often prohibitive. Its greatest liability is its exasperate waste of space since architectural utilization of space within or immediately contiguous to the cloverleaf system itself is totally impossible.

The discomfort of our present day traffic light controlled city intersection represents our failure to revise an archaic checkerboard planning approach whose original concept was sound but which fails to meet the needs of highly developed modern societies need of easy transport over substantial distances in a rapid manner.

A typical traffic intersection of two-way streets in a modern city contains at least 12 traffic lines out of which eight of them are engaged in the dangerous business of intersecting one another at as many as 12 points of possible vehicular contact, without counting the chance effect of undesired pedestrian contact. The danger of vehicles colliding with one another has been attempted to be controlled either by the four-way stop sign, or more sophisticatedly by the dynamic signal language of red, green, and yellow traffic control lights. Unfortunately, these systems function rather submissively at the expense of a great loss of time and peace of mind, particularly when heavy and uneven traffic loads are involved.

The cloverleaf and the city intersection systems have been accepted as being feasible only as a result of isolated type thinking and decision making by modern man. Without much consideration of the consequences that may result, there has been over emphasis on the specific goal of performance such as in speed and efficiency facilitated by a cloverleaf system even for the heart of a city.

Unsightly structures that invade vertical as well as horizontal spaces in metropolitan areas are the consequence of our over-emphasis on the time feasibility of a cloverleaf system and its like. The frustration of abrupt stop and eager crossing is the price of space feasibility of the conventional traffic light system. On top of all this, both systems contribute to the agony of both air and noise pollution.

The subject invention eliminates the drawbacks of prior known traffic systems through the employment of flow systems based upon the hexagon in a manner that will be fully appreciated when the following written description is considered in conjunction with the appended drawings in which:

FIG. 1 is a plan view of a conventional cloverleaf traffic control system;

FIG. 2 is a plan view of a plurality of conventional intersections illustrating different traffic flow operations therethrough;

FIG. 3A is a plan view of one aspect of a preferred embodiment of the invention consisting of a plurality of discrete intersections;

FIG. 3B is a plan view of the intersections of FIG. 3A joined together to form an interlinking traffic flow system;

FIG. 3C is a plan view of another aspect of the preferred embodiment in which the blocks form units of nonuniform honeycomb shape;

FIG. 4 is a plan view of a uniform honeycomb block system illustrating traffic flow therethrough;

FIG. 14 is a plan view of another aspect of the invention;

FIG. 15 is a plan view of another aspect of the invention; and

FIG. 16 is a plan view of another aspect of the invention.

Closely approximating a circle which contains maximum content with minimum perimeter, a hexagonal form employing wishbone intersections 20 (FIG. 3C) is adopted as the basic unit of a honeycomb because it is most incorporative with its own peers. It excels over a square in economy and an octagon in stability and can assume various shapes as shown in FIG. 3C. It also affords the best opportunity for one hexagon to be directly connected to six other hexagons.

The honeycomb concept when translated into city planning language means maximum usage of acreage of each hexagonal block made available and accessible at every side by minimum length of surrounding roads which are shared by other contiguous hexagonal city blocks as shown in the enlarged layout of uniform hexagonal blocks in FIG. 4 in which the streets comprise two-way traffic in portions 22 and one-way traffic in portion 24. It will be seen that merging and divergence of north-south and east-west traffic is achieved at each wishbone node such as node B4 and node C6. Consistent one-way counterclockwise traffic continuity is provided for a series of successive blocks along an east-west axis such as those marked Y and Z, etc., in Drawing 4. Note that there are two avenues (not one combined two-way avenue) between blocks such as Y and Z. The rotation direction of continuous traffic around each block for series of successive blocks along east-west axis will be alternated from north to south and vice versa. The series of blocks V, W and X will be in clockwise direction while S, T and U will be in counterclockwise direction.

Figure 5:
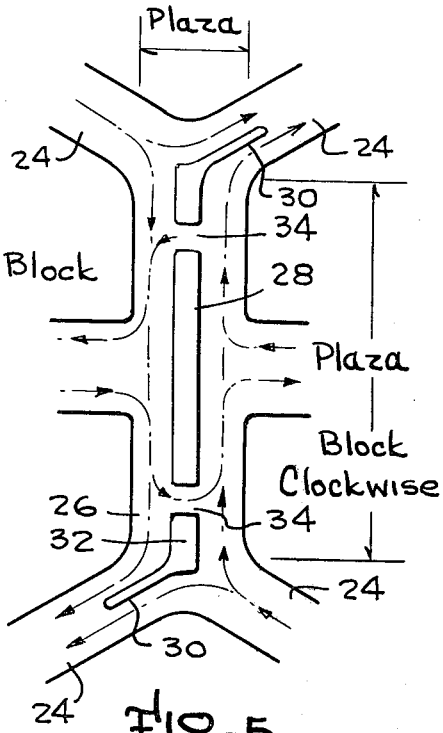
FIG. 5 is an enlarged plan view of a two-way traffic portion usable in the system of FIG. 4 illustrating the flow around the blocks in clockwise manner.
Figure 6:
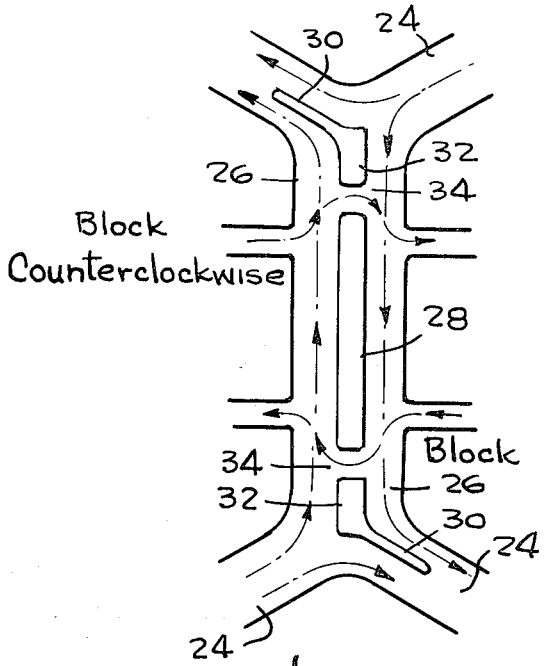
FIG. 6 is identical to FIG. 5 but illustrates the block flow in counterclockwise manner.
Figure 7:
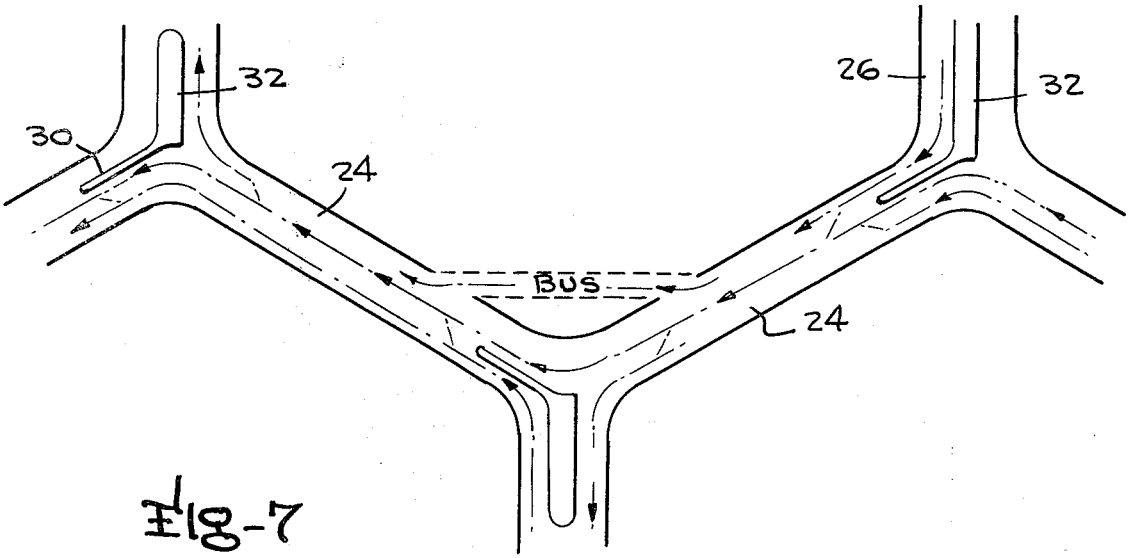
FIG. 7 is a plan view of another aspect of the invention illustrating an intersection embodying an associated bus stop portion.

Other features of the inventive system of FIG. 4 include non-stop zig-zag east to west traffic along Street B and Street D and non-stop zig-zag west to east traffic along Street A and C. Non-stop south to north traffic runs alternatively along sections of Avenue 6 and Avenue 5, to be connected by diagonal streets between them. Similarly, non-stop north to south traffic runs alternatively along sections of Avenue 7 and Avenue 6, also to be connected by diagonal streets between them. FIG. 5 illustrates the fact that both these south to north and north to south traffic lines have to go across a plaza 26. The plaza 26 is a space consisting of two separate avenues whose traffic is opposite in direction and which are separated by a main vertical median wall 28 and which are deflected at their ends by diagonal flow-merge medians 30 extending outwardly from end median walls 32. U-turns from one avenue to another within the plaza are enabled through spaces 34 between main median wall 28 and end median walls 32. Between blocks whose surrounding traffic is in a clockwise direction, each avenue is conventionally directed so that its traffic flows at the right-hand side of the plaza. Example: Avenue BC-6. Between blocks whose surrounding traffic is counterclockwise, however, an unconventional flow pattern which requires each avenue to flow at the left-hand side of the plaza is employed; however, within each avenue, its own traffic still sticks to the conventional rule of keeping still sticks to the conventional rule of keeping to its own right. FIG. 7 illustrates a system in which cars that are moving toward south or north and cars that are moving toward east and west would have to intersect each other tangentially along the diagonal streets. This is accomplished by tactful change of lane with the qualifications that three lanes be provided for each street 24. Cars in the left lane, if need to, should change lane earlier to middle lane and be ready to shift further to the right or vice versa. There should be a regulated car to car spacing good enough for cars in other lanes to come in between the cars so spaced. Significant aspects of the nomenclature as depicted in FIG. 4 include:

1. All avenues running toward north or south are numbered. Because blocks between Street B and Street C are interposed with blocks both between Street A and B and between Streets C and D by alternating the position of avenues, numbering provides an opportunity to define the edge of each block either by a pair of odd-numbered avenues or that of an even-numbered one. Example: Avenues 7 and 5 for Block Z and Avenue 6 and 4 for Block X.

2. The number sandwiched between a pair of odd or even numbers then can be used to denote a block. The block temporarily identified as Z, which is bordered by Avenue DC-7 and Avenue CD-5, for instance, is identified as block CD-6. Notice that the appearance order of the letters in the nomenclature of an avenue or a street represents the direction of traffic flow.

3. All the streets have to be denoted by letters because the alphabet system is the only one other than the number system that is arranged in a customary and familiar order suitable to reflect the essence of sequence and direction of a honeycomb system.

4. In terms of location as well as direction, therefore, the street on which one is supposed to move from node C7 to node C6 shall be called Street C-7-6 and continuous eastward C-6-5, C-5-4, etc.

5. Direction will give us an opportunity to differentiate the avenues which are identified by the same number within the same plaza. The two avenues between blocks temporarily marked Y and Z, for instance, shall be named Avenues CD-7 and DC-7 depending on the direction of traffic flow from one node to another, C to D or D to C.

6. The sequence of numbers ranging from east to west is designed to correspond with the position of the sun after sunrise.

7. In arbitrary order of appearance between them, combination of number and letter shall denote a node.

Figure 8:
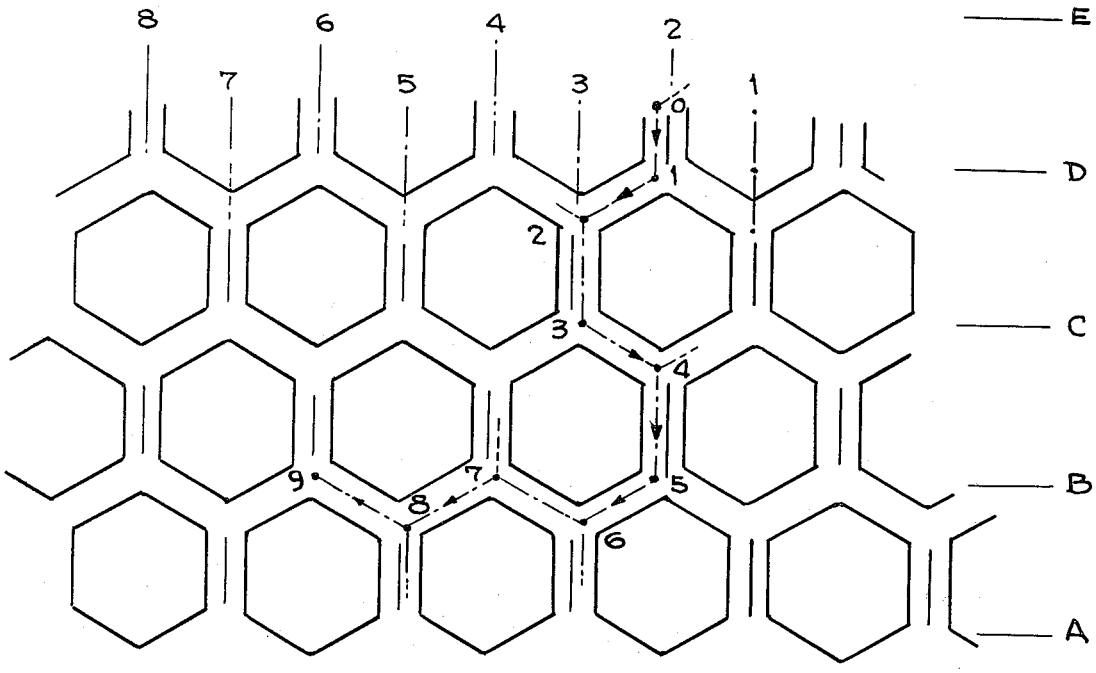
FIG. 8 illustrates a system of street nomenclature employable with the invention traffic flow system.

The honeycomb system is by no means more complicated than an ordinary checkerboard system since the location of any place can be readily identified in terms of street letter and avenue number in such a way quite familiar to ourselves. The only complication involved, if we call it a complication at all, is that because of lack of long straight streets or avenues, one does have to travel in a zig-zag manner as shown in FIG. 8.

The immediate encouragement one can see in a wishbone is that it does not ask any driver to make a choice out of more than two directions when he arrives at a turning point. In fact, when a car comes out from an avenue in either direction, one finds it unnecessary to make a choice at all.

For the sake of simplicity and consistency, the short-cut U-turn between opposite avenues comprises an additional choice of the otherwise single-choice turning point ahead of the U-turn. Thus, we would be able to treat all turning points as being equally binary. We may then have the opportunity to use the binary sequence in exponential form to represent the sequantial potentiality of destination diversification in the mind of a departing driver.

The term $2^3$ within the binary sequence shown in the lower part of Drawing 8 represents the consumption of eight possibilities along a certain route after the turning point number 3, which is numercially represented by the power of 3 in the term $2^3$. If the digit 1 represents a right turn and digit 0 a left turn, the hourney which one has to traverse from point 0 (node E2) to point 9 (node B6) in Drawing 8 would be: (leading from right to left in the lower part of Drawing 8, connotationally in association to computer methodology; left to right below), Departure E2 1-1-0-0-1-1-1-0-1 Destination B6.

Simply stated, the sequence of these binary numerals represent the direction pattern of a journey.

Series of such binary numerals could be tabulated in correspondence to combinations of departure and destination nodes for newcomers' information. It could, of course, be computerized to render instant coordination of dispatch service for a taxi company.

Figure 9:
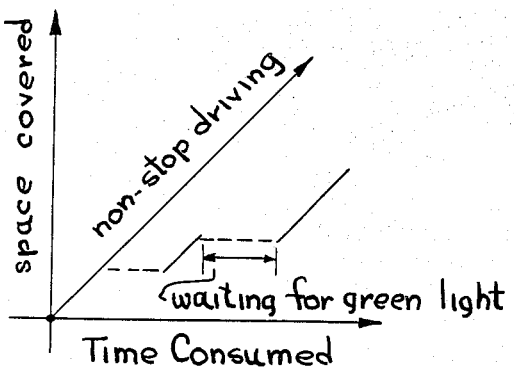
FIG. 9 is a time versus distance graph.

There is no need to strive for higher speed with the honeycomb system as shown by FIG. 9. The time saved from unnecesary waiting at a conventional street light is easily apparent.

Figure 10:
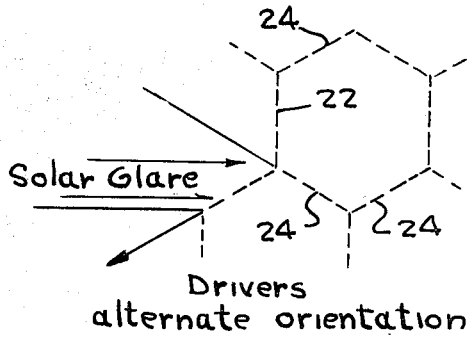
FIG. 10 is a plan illustration of the manner in which the problems of solar glare are avoided by the inventive system.
Figure 11:
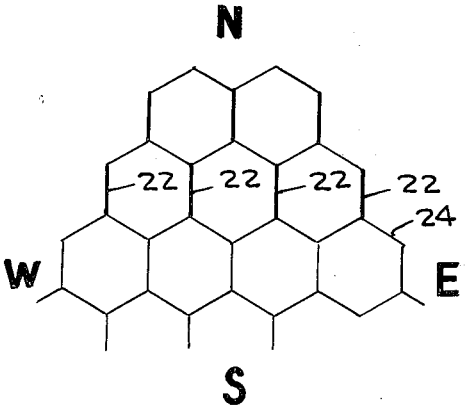
FIG. 11 is night-time plan view of the inventive traffic layout system as it would appear from the air.

The hazard for one to face the glare of a setting sun when he is driving toward the west end of a road is avoided by the honeycomb system as shown in FIG. 10.

For the pilot in the sky as well as the driver on the ground, the orientation of the honeycomb city form is clarified by its zig-zag streets, which run east and west, and sections of parallel heavier lines for for north and south.

Figure 12:
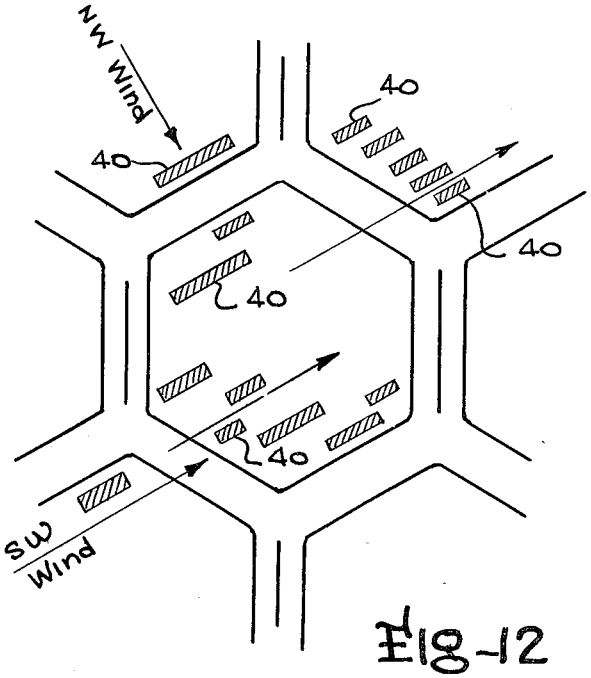
FIG. 12 is a plan view illustrating the manner in which building orientation can be provided with the inventive system for optimum climatic benefit.
Figure 12A:
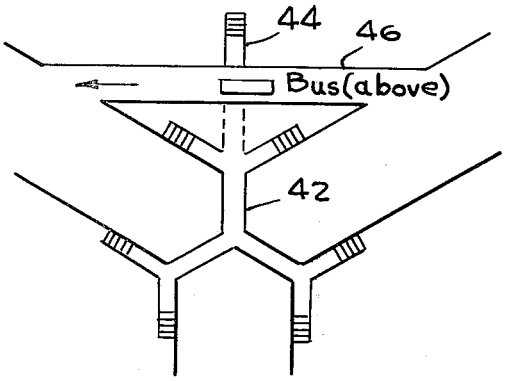
FIG. 12A is an enlarged plan view illustrating another embodiment of the subject invention.
Figure 13:
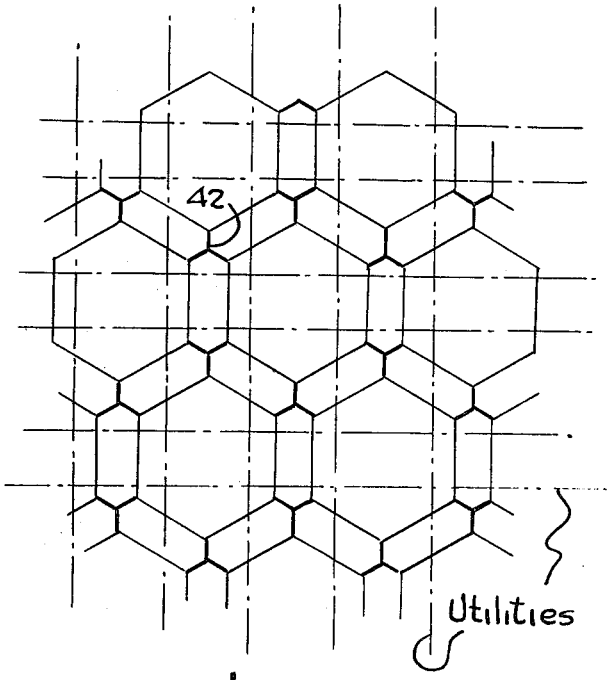
FIG. 13 is a plan view illustrating the manner in which the embodiment of FIG. 12A are associated as part of a larger scale traffic flow system.

For many geographical locations, the zig-zag situation of all streets is such that buildings built along a street can be logically and consistently arranged to block north-western wind during the winter and to allow for the passing of summer breezes, with ends or sides of buildings more parallel to the streets, from south-western side of the city as shown in FIG. 12.

The honeycomb traffic pattern enables the employment of alternate building designs oriented so as to resist the north-west wind in winter but permit the passage of south-west breezes in summer, as is shown by buildings 40 in FIG. 4.

To be consistent with the non-stop flow of vehicular traffic, pedestrian overpaths or underpaths are provided in the manner illustrated in FIG. 12-A. While a pedestrian overpath is reasonable for linking upper floor spaces of buildings on opposite sides of the traffic arteries, an underpath pedestrian crossing of an avenue or of a street is more desirable. Instead of a 14 foot truck clearance needed for an overpath, a mere seven feet plus 2 feet of construction depth is all we need for an underpath.

FIG. 12-A illustrates the most logical location and design of an underpath system in the form of a wishbone connection 42 which is accessible to three hexagonal blocks. One leg 44 of the wishbone could be extended to allow for an off-street bus stop.

The problem of such an underpath system is that it will create a probable competition for vertical space immediately below a road surface between the pedestrian tunnel and the space for public utilities. One way to solve the problem is to position all the utilities under the inner side of a sidewalk 47 and reserve enough space near the road curb for steps 48 leading to or starting from a leeward underpath as illustrated in FIG. 14.

FIG. 15 illustrates a six-line pattern for a rapid transit system that is suitable to our need. Elevated or underground, the six two-way lines 50 are linked by a revolving shuttle system in the heart of a city.

The system disclosed in FIG. 16 allows for North-South traffic 60 to go straight while East to West traffic or vice versa is economized by turning to North or South, for saving spaces for elevated through-ways, pedestrian malls and the like along the North-South axis. It should be understood that the directional terms "north", "south", "east" and "west" are used to conveniently define directions of the street components relative to each other (i.e. an east-west street would be perpendicular to a north-south street) and these terms should not be interpreted as necessarily being geographical directions.

The application of the tangential-crossing pattern within the framework of our present street system is possible, again, only if the design of a twin-avenues concept is adopted.

Numerous modifications of my invention will undoubtedly occur to those of skill in the art. For example, the number of traffic lanes in each direction on the streets and avenues of all embodiments can be from one lane up to many lanes such as ten or more. Consequently, it should therefore be understood that the spirit and scope of the invention is to be limited solely by the appended claims.

I claim:

1. A street layout traffic control system comprising a plurality of identical honeycomb blocks each having six sides of identical length with the facing sides of adjacent blocks being parallel and defining the sides of vehicular arteries consisting of linear two-way north-south arteries branching into one-way streets oriented at approximately 300° and 60° heading for vehicles entering said streets in a northerly direction of movement at the northern ends of said north-south arteries and oriented at 240° and 120° heading for vehicles entering said streets in a southern direction of movement at the southern ends of said north-south arteries.

2. The invention of claim 1 additionally including a vertical median wall in said north-south arteries for separating the northbound traffic from the southbound traffic.

3. The invention of claim 1 additionally including a vertical median wall in said north-south arteries for separating the northbound traffic from the southbound traffic and diagonal flow-merge medial walls at the northern and southern ends of said north-south arteries unitarily consisting of a north-south wall portion oriented medially of the north-south arteries at their northern or southern ends and a street median oriented medially of the one-way street adjacent said northern or southern ends and extending outwardly in the direction of traffic flow in the one-way street in which said street median is positioned.

4. The invention of claim 3 wherein the northern and southern ends of said median walls in said north-south arteries are spaced respectively from the southern and northern ends of said north-south wall portions so as to define a U-turn permitting space therebetween.

5. The invention of claim 4 additionally including east-west oriented plaza means extending across said honeycomb blocks between the north-south arteries on the east and west sides of said honeycomb blocks.

6. The invention of claim 4 additionally including east-west oriented two-way plazas extending across said honeycomb blocks between the north-south arteries on the east and west side of said honeycomb blocks.

7. The invention of claim 5 wherein said plaza means comprises two one-way thoroughfares, one of which is east bound and the other of which is west bound.

8. The invention of claim 3 additionally including east-west oriented bus stop lanes extending between intersecting one-way streets.

9. The invention of claim 8 additionally including a vertical median wall in said north-south arteries for separating the northbound traffic from the southbound traffic.

* * * * *